US011952777B2

(12) United States Patent
Moser Rossel

(10) Patent No.: US 11,952,777 B2
(45) Date of Patent: Apr. 9, 2024

(54) MODULAR CEILING ACCESSIBLE ONE BY ONE, HIDDEN GRID, RESTING ON ALL FOUR SIDES, ALLOWING FOR REDUCED THICKNESS AND LARGER FORMATS

(71) Applicant: Roberto Felipe Moser Rossel, Santiago (CL)

(72) Inventor: Roberto Felipe Moser Rossel, Santiago (CL)

( * ) Notice: Subject to any disclaimer, the term of this patent is extended or adjusted under 35 U.S.C. 154(b) by 421 days.

(21) Appl. No.: 17/261,383

(22) PCT Filed: Jun. 24, 2019

(86) PCT No.: PCT/CL2019/000026
§ 371 (c)(1),
(2) Date: Sep. 17, 2021

(87) PCT Pub. No.: WO2020/014796
PCT Pub. Date: Jan. 23, 2020

(65) Prior Publication Data

US 2022/0010555 A1 Jan. 13, 2022

(30) Foreign Application Priority Data

Jul. 19, 2018 (CL) ..... 1963-2018

(51) Int. Cl.
*E04B 9/28* (2006.01)
*E04B 9/06* (2006.01)

(52) U.S. Cl.
CPC ..... *E04B 9/28* (2013.01); *E04B 9/067* (2013.01)

(58) Field of Classification Search
CPC ..... E04B 9/28; E04B 9/067; E04B 9/0435
See application file for complete search history.

(56) References Cited

U.S. PATENT DOCUMENTS 6,260,325 B1 7/2001 Wendt et al.
7,536,836 B2 * 5/2009 Moser Rossel ..... E04B 9/003 52/506.01

(Continued)

FOREIGN PATENT DOCUMENTS

EP 2631381 A1 * 8/2013 ..... E04B 9/0435
FR 1313963 A * 1/1963

(Continued)

OTHER PUBLICATIONS

International Search Report for PCT/CL2019/000026, dated Oct. 7, 2019.

*Primary Examiner* — Adriana Figueroa
(74) *Attorney, Agent, or Firm* — Troutman Pepper Hamilton Sanders LLP (Rochester)

(57) ABSTRACT

The present invention discloses a rectangular ceiling module, accessible one by one, that allows the use of larger-than-standard, reduced-thickness formats, with a front face, a rear face and four edges, with corners forming obtuse angles and robust geometry; it is installed from below without surpassing the height of the standard support grid; it rests on the grid by its four edges or sides and leaves the grid hidden. The module is useful as a standard false ceiling, hiding air-conditioning installations, electrical installations, fire-protection systems, low-current systems, etc., located under the slab, mostly in office buildings, while also serving as an element of insulation and/or sound absorption, depending on the material used.

12 Claims, 14 Drawing Sheets

(56) References Cited

U.S. PATENT DOCUMENTS

| | | | | |
|---|---|---|---|---|
| 7,908,813 | B2 * | 3/2011 | Gulbrandsen | E04B 9/045 52/506.07 |
| 2006/0162283 | A1 | 7/2006 | Moser Rossel | |
| 2015/0027075 | A1 * | 1/2015 | Wilkens | E04B 9/30 52/582.1 |

FOREIGN PATENT DOCUMENTS

| | | | |
|---|---|---|---|
| FR | 1313963 | A | 1/1963 |
| IT | PD20090358 | A1 | 5/2011 |

* cited by examiner

Figure 2A
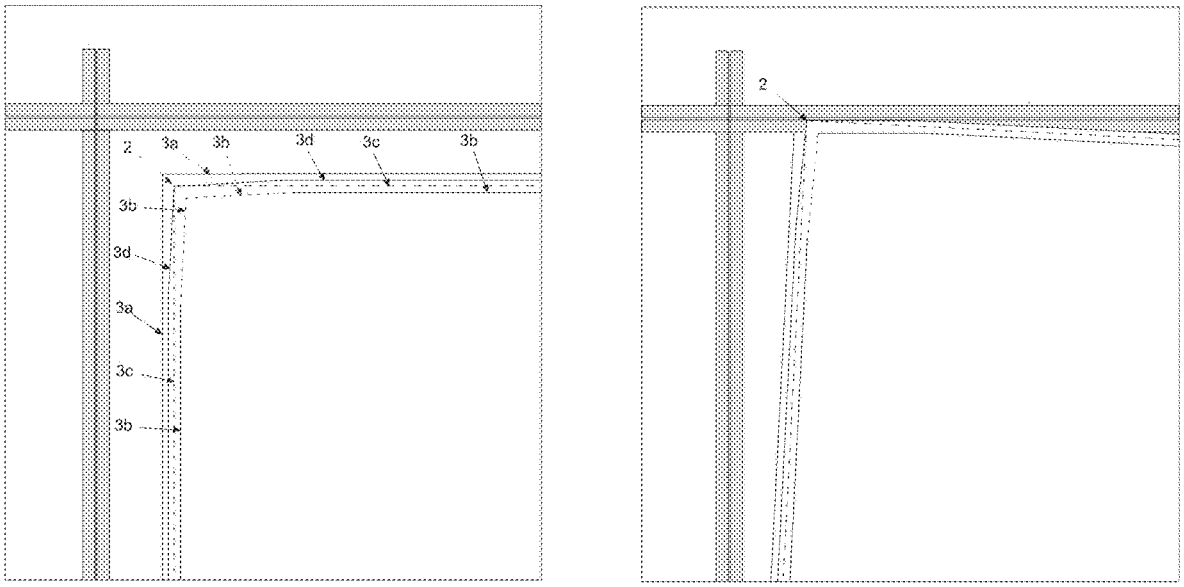
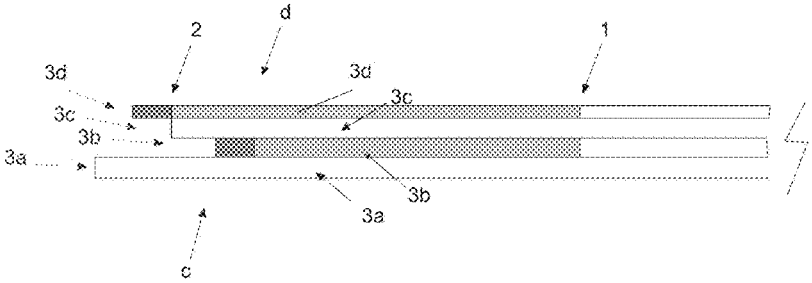
Figure 2B

Figure 11A
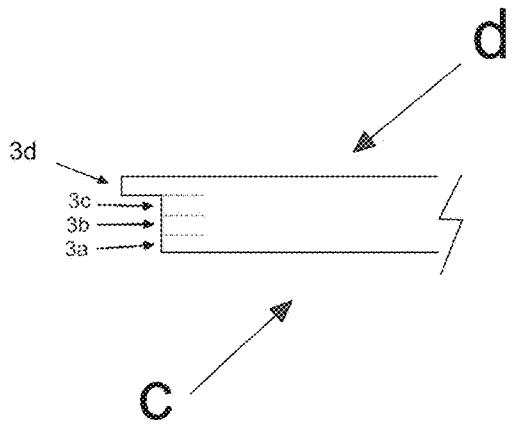
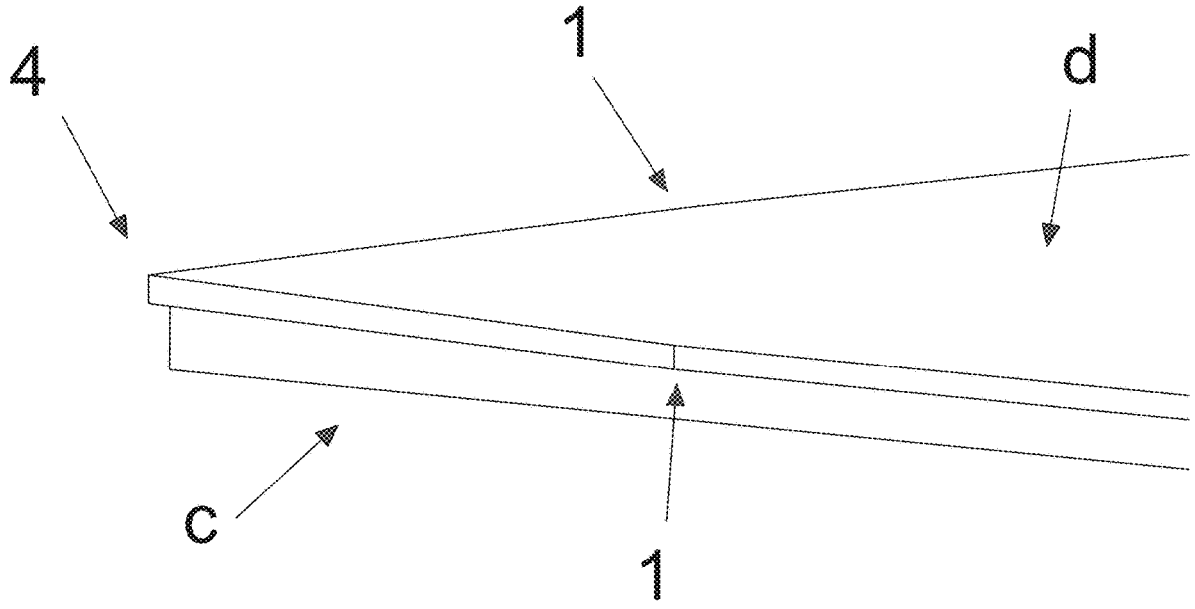
Figure 11B

MODULAR CEILING ACCESSIBLE ONE BY ONE, HIDDEN GRID, RESTING ON ALL FOUR SIDES, ALLOWING FOR REDUCED THICKNESS AND LARGER FORMATS

This application is a national stage application under 35 U.S.C. § 371 of PCT Application No. PCT/CL2019/000026, filed Jun. 24, 2019, which claims the priority benefit of Chile Application Serial No. 1963-2018, filed 19 Jul. 2018, which are hereby incorporated by reference in their entirety.

BACKGROUND

In the world of construction, where the plenum is used to carry the facilities of services such as electricity, fire systems, air conditioning systems, etc., the removable modular ceiling is commonly used to give a flat termination and allow access to this equipment. For its installation, a standard profile is used that hangs from the slab, and is known as a 15/16 profile in inches, or 24 mm profile in metric. A 61×61 cm or 61×122 cm grid is assembled on which the modular ceiling is installed, leaving the profiles visible. As an evolution of a better aesthetic presentation, low-edged ceiling modules were developed, where the module, as its name indicates, has a recess in its four support edges, which allow the palmette or module to lower more than the profile, taking away the aesthetic prominence from the profile. An even better aesthetic alternative is that of modules that hide the profiles, where the dimensions of the face of these modules is greater than the space left by the support grid. A standard 15/16 grid (24 mm face), composed of 366 cm principals and 122 cm and 61 cm secondaries, leaves a clearance between profile edges of 586×586 mm or 586×1.196 mm (610−24=586 mm or 1,220−24=1,196 mm). Depending on the solution used, they hide the grid, leaving a stonework between the modules that ranges from 1 mm to 6 mm, depending on the chosen system. The smaller the quarry, the smoother the modular ceiling is perceived as a whole.

In the market for accessible modular ceilings that hide the support profiles and leaving leave a stonework in sight, there are several alternatives that have the characteristic that they are supported on two sides, requiring attached elements such as hooks, folded cans, etc. that act as a retention or safety element when the module, due to a manipulation movement or a telluric movement, has released one of its supports, so the module falls to the ground (examples, Natura de Hunter Douglas or Armstrong Vector).

By leaning on two sides, these modules also have the limitation that the distance between the two support points is limited, since the force of gravity introduces inflexion on these modules and causes them to deform due to its action. To avoid deformation, these types of ceilings are forced to have a maximum width format (between the two supported edges) of 61 cm and a material thickness of 16 mm for agglomerates and 18 mm for mineral fiber.

A better solution to the previously described alternatives of ceilings with hidden profile is the Chilean patent No. 200500058, entitled Recordable Sky Module and patents US20060162283 and the European patent No. EP1690994.

The fundamental characteristic of these solutions is support on four sides, where its installation is carried out using recesses on the shorter sides of the module, which cut the geometry of the edge, maintaining continuity only on the face, in order to install it. This design is currently on the market and uses 12 mm medium density fibropanel as a substrate, (mdf=medium density fiber panel) that does not deform because it rests on all four sides, which works without problems since its density is proper for the design of the edges, their resistance, and the dimensions of the modules, which cannot exceed 61 cm on the shorter sides, where the installation recesses go. If you wanted to make a ceiling module with a width of 122 cm, you would have to increase the length of the outlet or installation recess to such a degree that it jeopardizes the effectiveness of the anti-seismic condition, leaving 90 cm as the deformation distance of the mdf board as a product of gravity, which would imply the need to use a greater thickness, therefore a greater weight. Therefore, the real range where this design can be used is, at most, a medium density fibropanel ceiling module of 12 mm of 61×122 cm and in the case of low-density materials, given the fragility of the shape of their edges, it can be used only in places where there is no need for registrability but for the acoustic capabilities of the mineral fiber module.

SUMMARY

The ceiling module of the invention allows its dimensions to be increased without losing its safety characteristics, not deforming and also reducing the weight per square meter by requiring a smaller thickness, which for MDF can be 9 mm and for mineral fiber 12 mm or 15 mm, the latter depending on the density of the material. In the case of lower density materials such as mineral fiber, they can be used in all places, regardless of the degree of their need for registrability.

BRIEF DESCRIPTION OF THE FIGURES

FIG. 2A-B: represents a perspective of a corner of an exemplary ceiling module, where the increase in thickness is appreciated when the first rectangle on the edge is added to the second.

FIG. 11A-B: represents a perspective of an exemplary lowered edge ceiling module, with the recess in a corner of a supporting edge.

DETAILED DESCRIPTION

Figure 1:
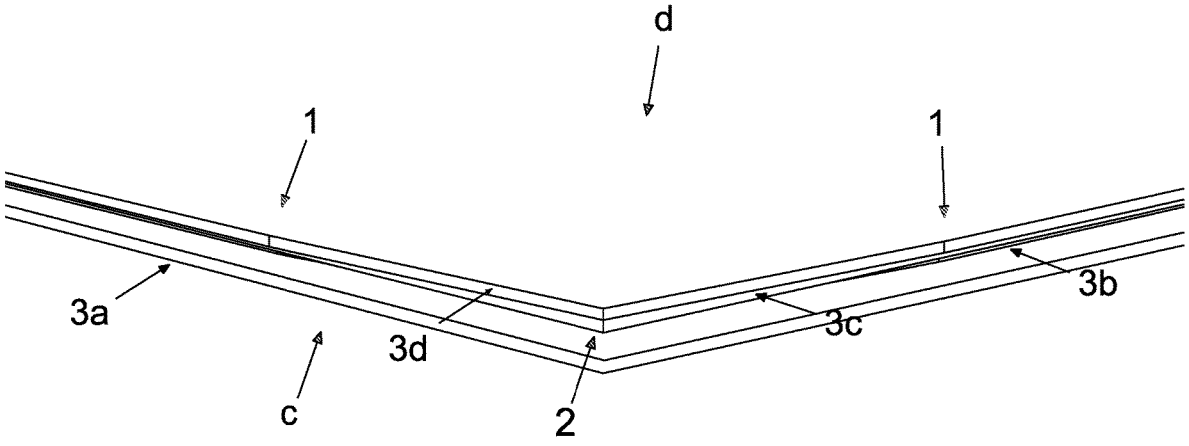
FIG. 1: represents a perspective of a corner of an exemplary ceiling module.

The technical problem that the new hidden profile registrable ceiling module solves is that it allows the use of low-density materials without registrability limitations, in formats greater than the standards and in thicknesses less than 12 mm, without losing anti-seismic safety characteristics and without deforming.

The registrable ceiling module of this technology does not differentiate between widths and lengths, since its four edges have the same design at the corners. For materials such as MDF or medium density fibropanel and others like it, it allows the use of 9 mm thicknesses, which implies a significant reduction in the final weight.

The invention is a rectangular registrable ceiling module with a face (c) that is visible from below and has the greatest dimension, four edges (3), each one composed of the recesses (3*a*), (3*b*), (3*c*) and (3*d*), which are also referred to herein as front flange (3*a*), installation recess (3*b*), fixing recess (3*c*), and support flange (3*d*), and a back (d) with a dimension greater than the distance between the edges of the profiles of the installation recess (3*b*) and the fixing recess (3*c*).

Generally this larger dimension is 5 mm more on each side and that is by means of which it is supported (i.e., support flange (3*d*)). This support flange (3*d*) has at least two recessed corners, the one that goes from point (1) to corner (2), increasing the angle of these corners resulting in obtuse angles, with each of the four corners optionally having an equal angle. Considering a 610×610 mm module, these recessed corners go from a right angle to an obtuse angle of 94° and the length of the distance from point (1) to corner (2) can be 10 cm. The length must be the same on all edges and may vary, depending on the format of the registrable ceiling module.

The corners (2) of this technology makes installation much more intuitive, simple, and performed in fewer steps. The angle of the corners increases from 90° to 94° by lowering the support flange (3*d*), which can be 3 mm thick and 5 mm deep at the point (1), from a distance of 10 cm, to 0 mm deep at the corner (2). The recess describes a diagonal from 10 cm from the corner (2), where the support flange (3*d*) has a depth of 5 mm to the corner (2), where its depth decreases until it reaches 0 mm. In the corner (2) the thickness of the support flange (3*d*) is added to the thickness of the fixing recess (3*c*), resulting in a support rectangle 7 mm thick and 6 mm deep, which is much more robust than prior art technology. The registrable ceiling module design, in addition to the above, hides the profiles, is installed from below without exceeding the height of the support profiles, can be registered one by one, individually, without difficulty or deterioration, and is anti-seismic as it is supported on its four sides.

The length of the corner recess (e.g., of the support flange (3*d*)) makes sense from 1 cm to 15 cm. If the length of the registrable ceiling module is 122 cm, 15 cm is justified. For a 61 cm side, a 10 cm recess is sufficient. To increase the dimensions of the registrable ceiling module from 61×61 cm to 122×122 cm, the design of the corners (2) remains unaltered, maintaining the security of its fixation, the simplicity of the installation, using the same standard profiles and also without the need to increase its thickness.

The edges (3) of the registrable ceiling module are made up of the recesses (3*a*), (3*b*), (3*c*) and (3*d*), which have as a restriction that, in order to be able to use separation edges of the registrable ceiling modules of 0.5 mm or more, its registration can be done one by one, simply and independently from the rest of the slefregistrable ceiling modules. This is achieved by making the face (c) have a thickness less than the sum of the rectangles in the middle of the registrable ceiling module (i.e., the fixing recess (3*b*)+the installation recess (3*c*)), plus the thickness of the support flange (3*d*), which is 1 mm.

The conditions that each of these rectangles that make up the edges must meet are:

- visible face (c) and edge (3): it must have a maximum thickness that allows entering the handling space left by rectangles two and three minus the thickness of the profile, which in the case of mdf should be 2×17 mm and for mineral fiber 15 mm should be 5×17 mm.
- installation recess 3*b*.—handling space: it must be high enough to be able to manipulate the profile inside while the installation is being carried out, which for MDF Gaso should be 2 mm and for 15 mm mineral fiber it should be 3 mm.
- fixing recess 3*c*.—spacer between profile edges: it must have a thickness that allows the module to easily find its position contained between the edges of the profile, which in the case of MDF should be 3×6 mm and for mineral fiber 5 mm it should be 4×6 mm.
- support flange 3*d*, —support on the profile; It must be solid enough to support the weight of the module, which for the 9 mm mdf case should be 2×5 mm and for the 15 mm mineral fiber it should be 3×5 mm.

The support of the registrable ceiling modules is carried out by means of a continuous profile with an inverted T shape, which is hung from the earthenware by means of wires or profiles designed for this function. They are hung at a distance of 1220 mm one from the other, separated by a registrable ceiling module of the same inverted T design, with which a mesh of 1220×1220 mm rectangles is assembled between axes, 1220×1220 mm grid.

If, parallel to the main profiles, another 1220 mm secondary profile is installed between the two 1220 mm secondary profiles, a grid of 1220×610 mm rectangles is formed. If these rectangles in turn are subdivided by means of a secondary of 610 mm between the main profile and the secondary profile parallel to this of 1220 mm, which is located between the main profile, squares of 610×610 mm are formed, with a grid of 610×610 mm.

All these grids are also supported by an angle-shaped profile that surrounds the entire perimeter, is fixed to the wall that contains the modular ceiling space and is called the perimeter profile. The width of the profile in its visible or lower part is 24 mm (15/16 inches). The fixing profiles or rectangles of the support grid are made of galvanized and enameled steel approximately 0.8 mm thick, The four corners (2) of the registrable ceiling module allow the installation to be carried out from a turning movement with displacement plus a straight diagonal adjustment.

Specifically, installation is carried out by inserting the installation recess (3*b*) in the corner (2*a*), until it touches the vertical wall of the fixing profile. This corner (2*a*) is moved parallel to its profile towards the corner of the grid (5), taking care that when the corner (2*b*) moves, the grid enters the installation recess (3*b*) of the registrable ceiling module until it touches the vertical wall of the fixing profile.

With both corners, (2*a*) and (2*b*), touching the fixing profiles on their vertical wall, the corner (2*a*) of the registrable ceiling module is moved to the corner (5) of the profile, producing a rotation of the registrable ceiling module that will carry the corner (2*b*) of the registrable ceiling module to the corner (6) of the fixing profile or support grid rectangle. In that position, the lengths (7) and (8) of the registrable ceiling module are supported against the respective fixing profiles, so that the opposite lengths of the registrable ceiling module are free from the fixing profile or support grid at the level of the back (d), so these corners opposite the corners (2*a*) and (2*b*) are raised over the fixing profile level or plane.

Once this has been achieved, the registrable ceiling module is moved diagonally in the direction of the corner (9), to locate the registrable ceiling module in the final position, where the registrable ceiling module goes down, remaining completely supported on the supporting flange (3*d*) and leaving the four lengths at the same distance from the support grid.

The registrable ceiling module uninstallation procedure consists of carrying out the reverse process, that is, the registrable ceiling module is lifted leaving the front flange (3*a*) touching against the fixing profile, the registrable ceiling module is moved diagonally towards the corner of the profile (5), up to a maximum position, that is, the lengths (7) and (8) remain touching the profiles, at which point the opposite corner (9) is free to lower the level with respect to the profiles. Next, the corner (2*b*) moves parallel to its respective profile, that is, two straight movements in a perpendicular direction produce rotation and translation which finally leaves the registrable ceiling module free, the registrable ceiling module being removed when it is rotated about 20 degrees with respect to the support grid.

Figure 12:
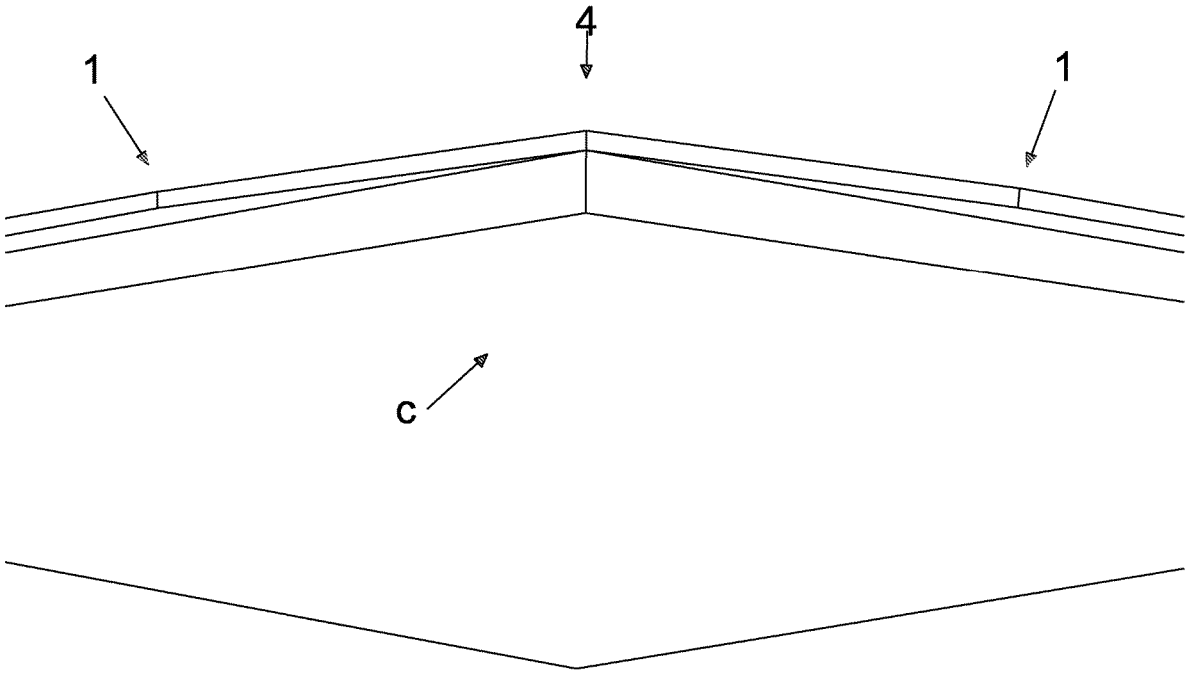
FIG. 12: represents a perspective from below of an exemplary ceiling module with the recess at the corners of the supporting edge.
Figure 13:
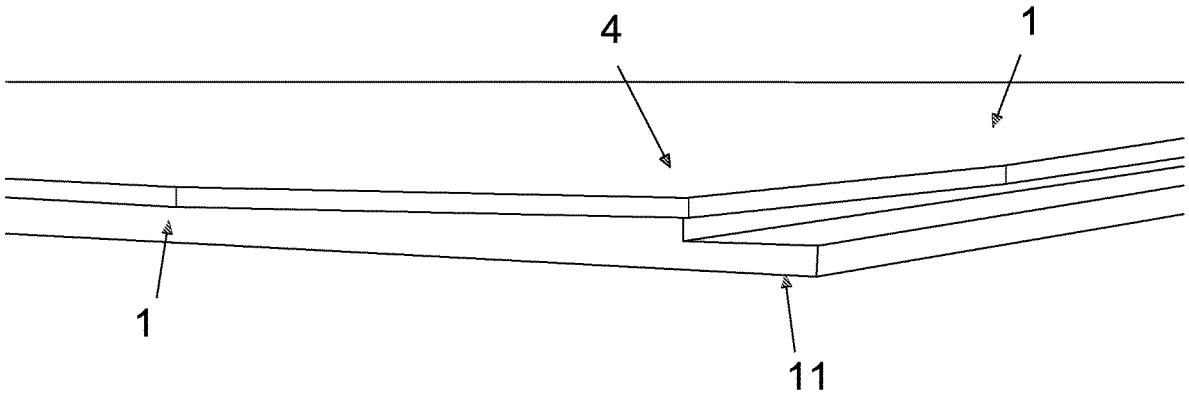
FIG. 13: represents a perspective of an exemplary lowered edge ceiling module with the recess in the corners of a supporting edge, with a protruding rectangle on a face.
Figure 14:
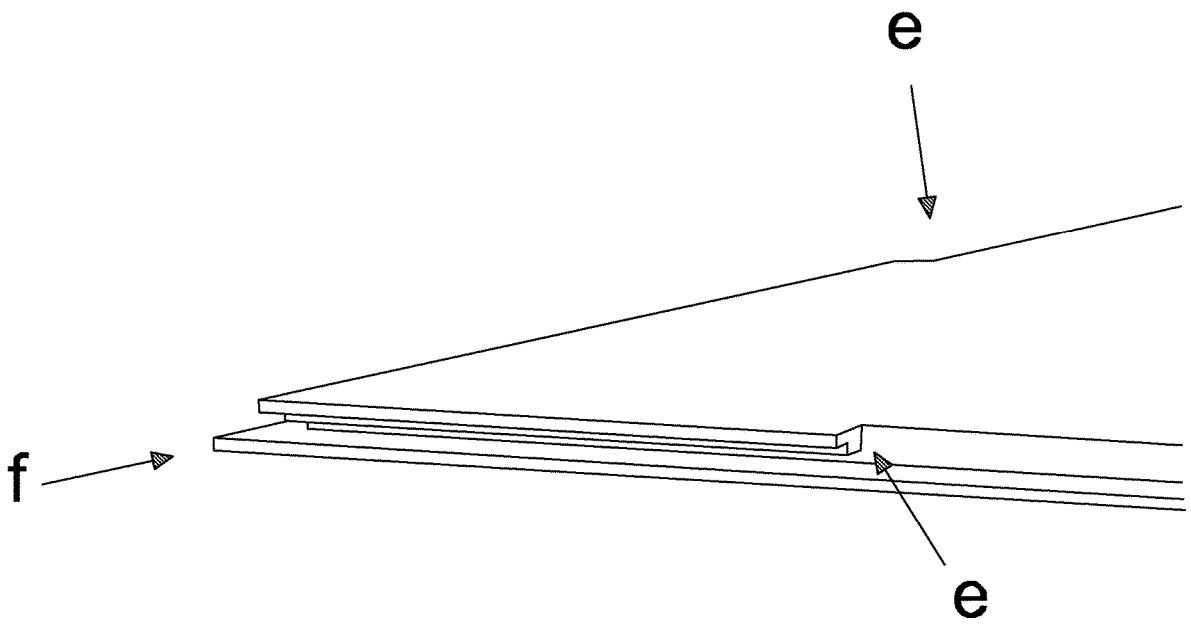

Referring now to FIGS. 11-14, if we consider a registrable ceiling module formed only by the back (d) and the fixing recess (3*c*), which is the one that is contained between the edges of the grid profiles, we have a Ganto registrable ceiling module recessed, where the fixing recess (3*c*) has a thickness of 9 mm, the distance from point (1) to corner (2) corresponds to the recess of the support flange (3*d*) and that for this case does not reach 0 mm in the corner (2), but at 2 mm (4), so that it cannot be seen from below, up the corner-(2). That is, it can be up to 0 mm as well, but it is not the most aesthetic.

Figure 3:
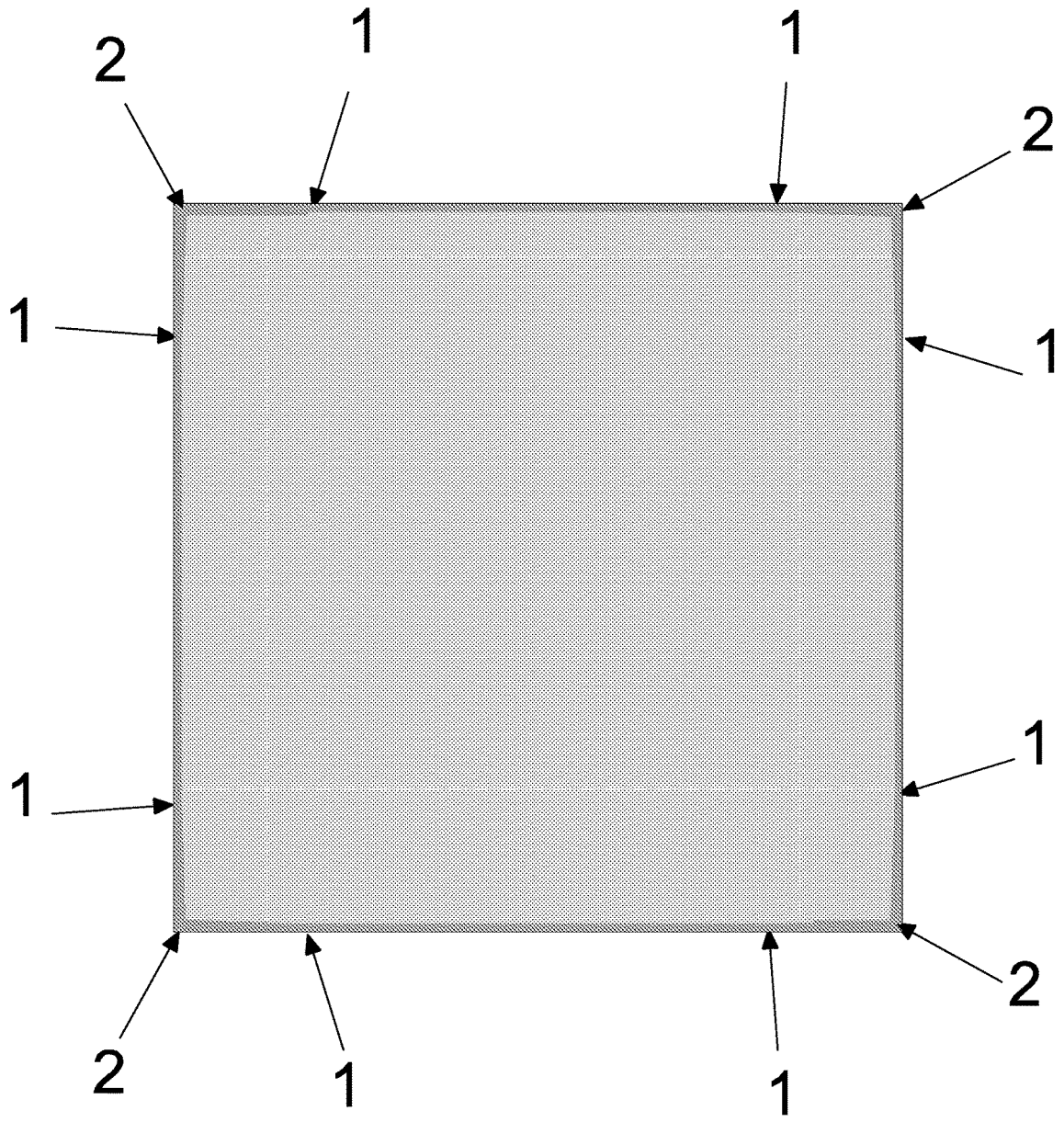
FIG. 3: represents a rear view, or a back view of an exemplary ceiling module.
Figure 4A:
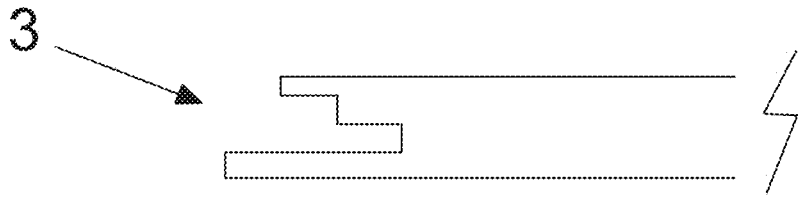
FIG. 4A-D: represents the sectional view of an edge, as it is located with respect to the profiles and the enumeration of the recesses.
Figure 4B:
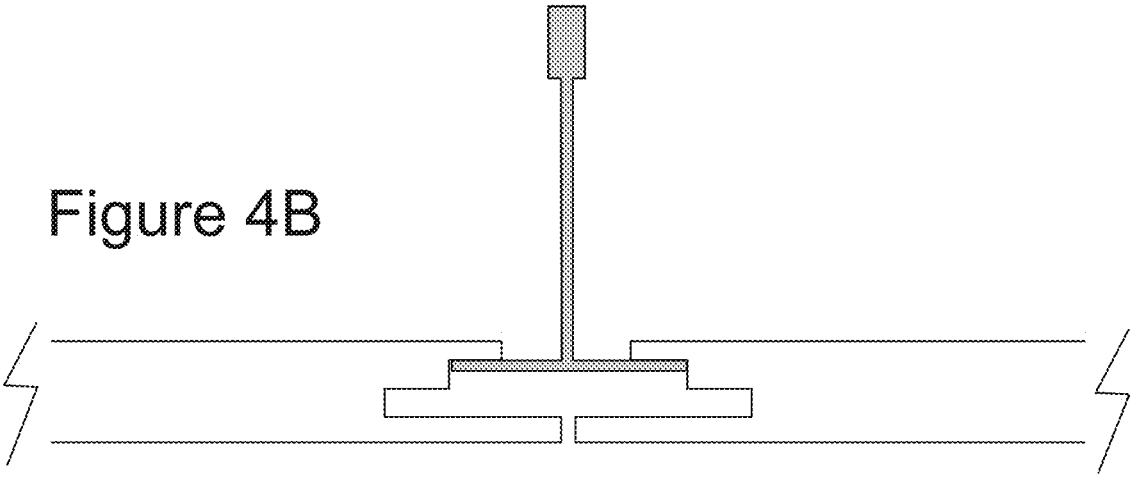
Figure 4C:
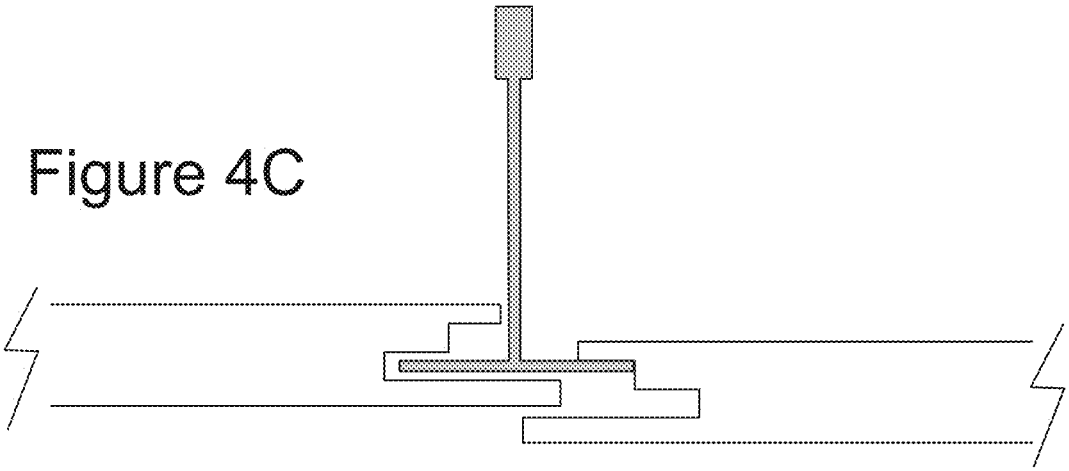
Figure 4D:
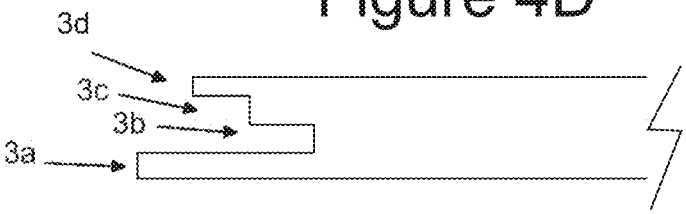
Figures 5A, 5B:
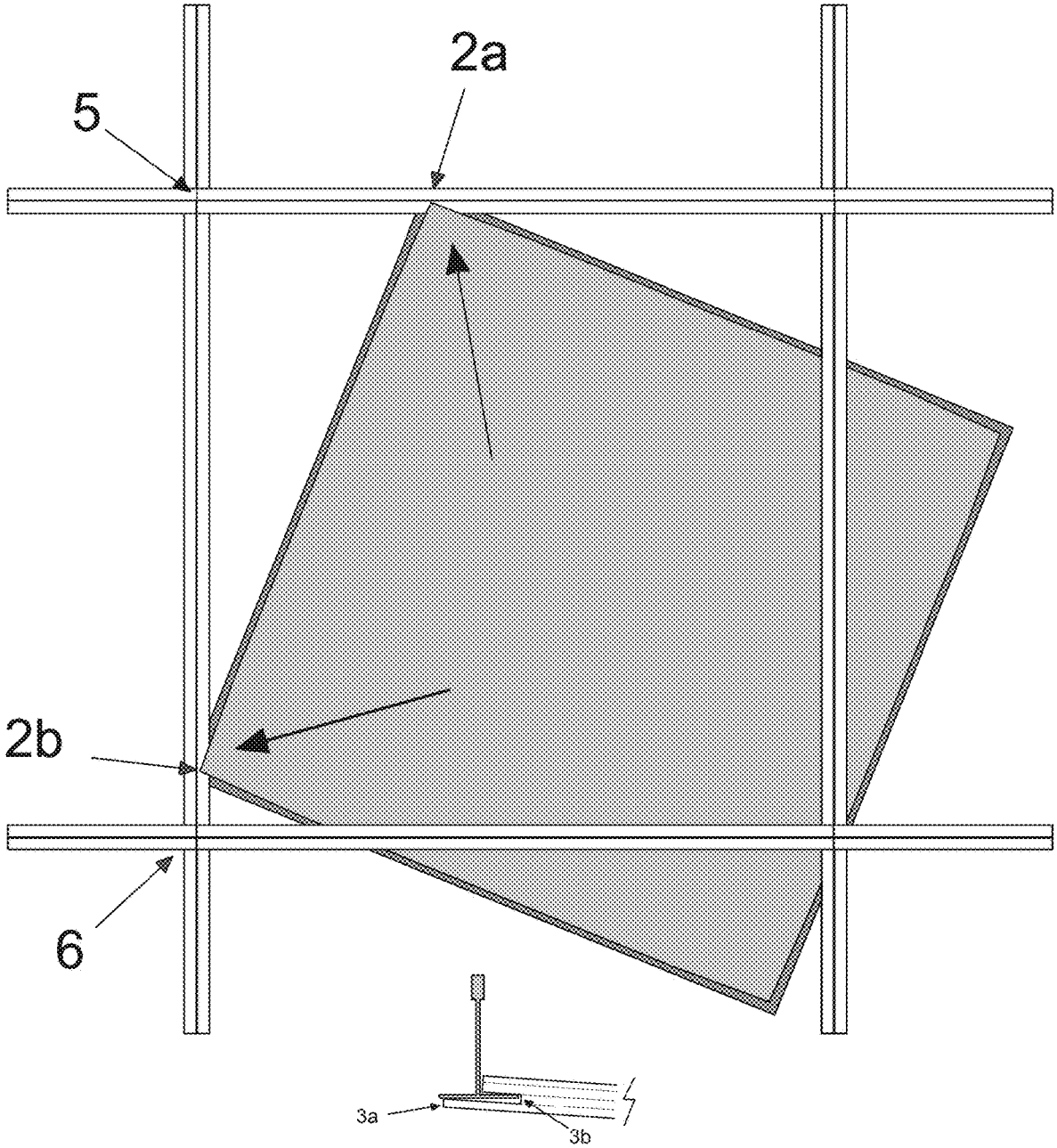
FIG. 5A-B: represents the position with which an exemplary ceiling module begins to be installed, in a standard reinforced grid.
Figure 6:
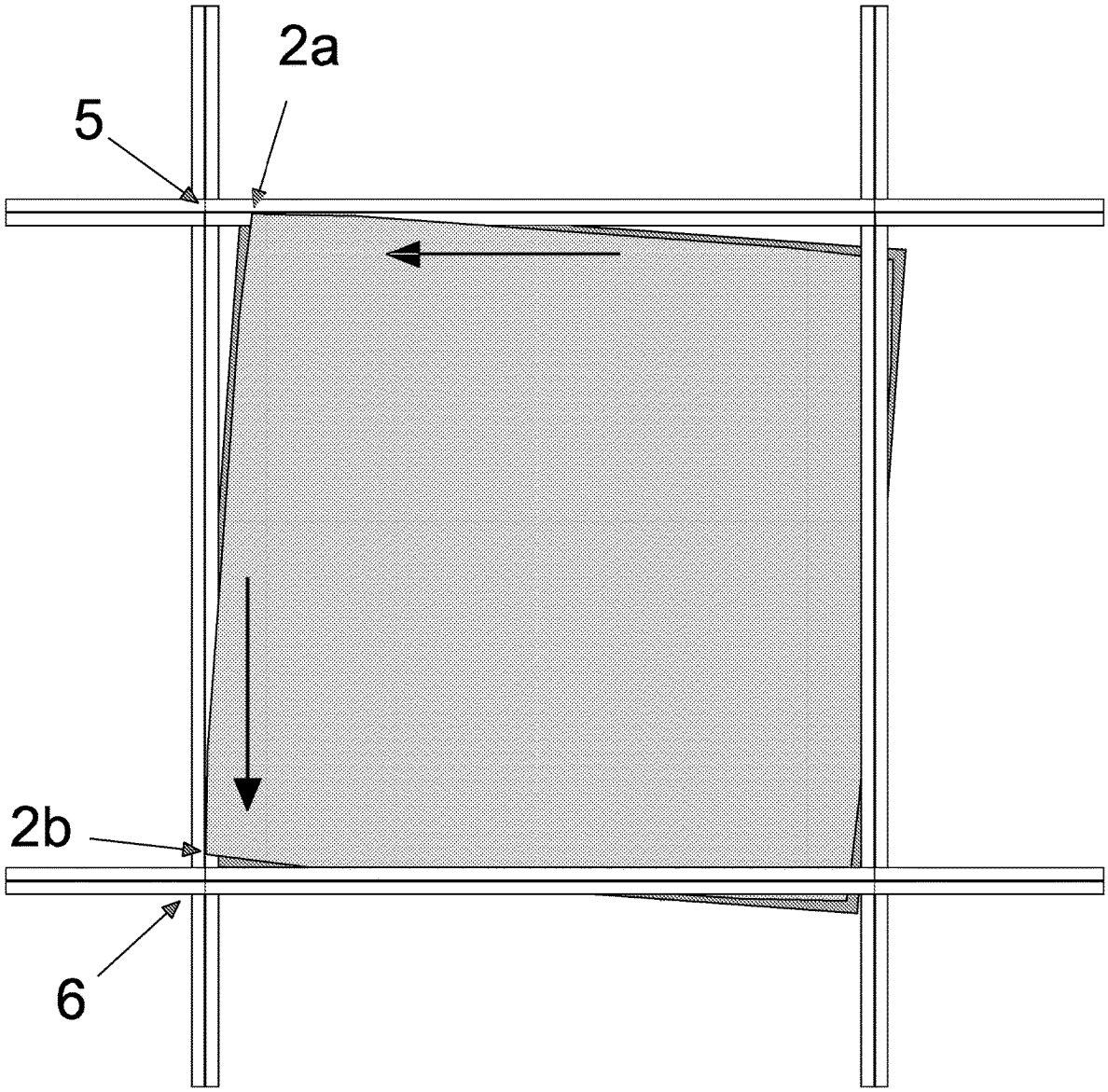
FIG. 6: represents a location position of an exemplary ceiling module in a grid when translation movement is applied, with the effect of rotation.
Figure 7:
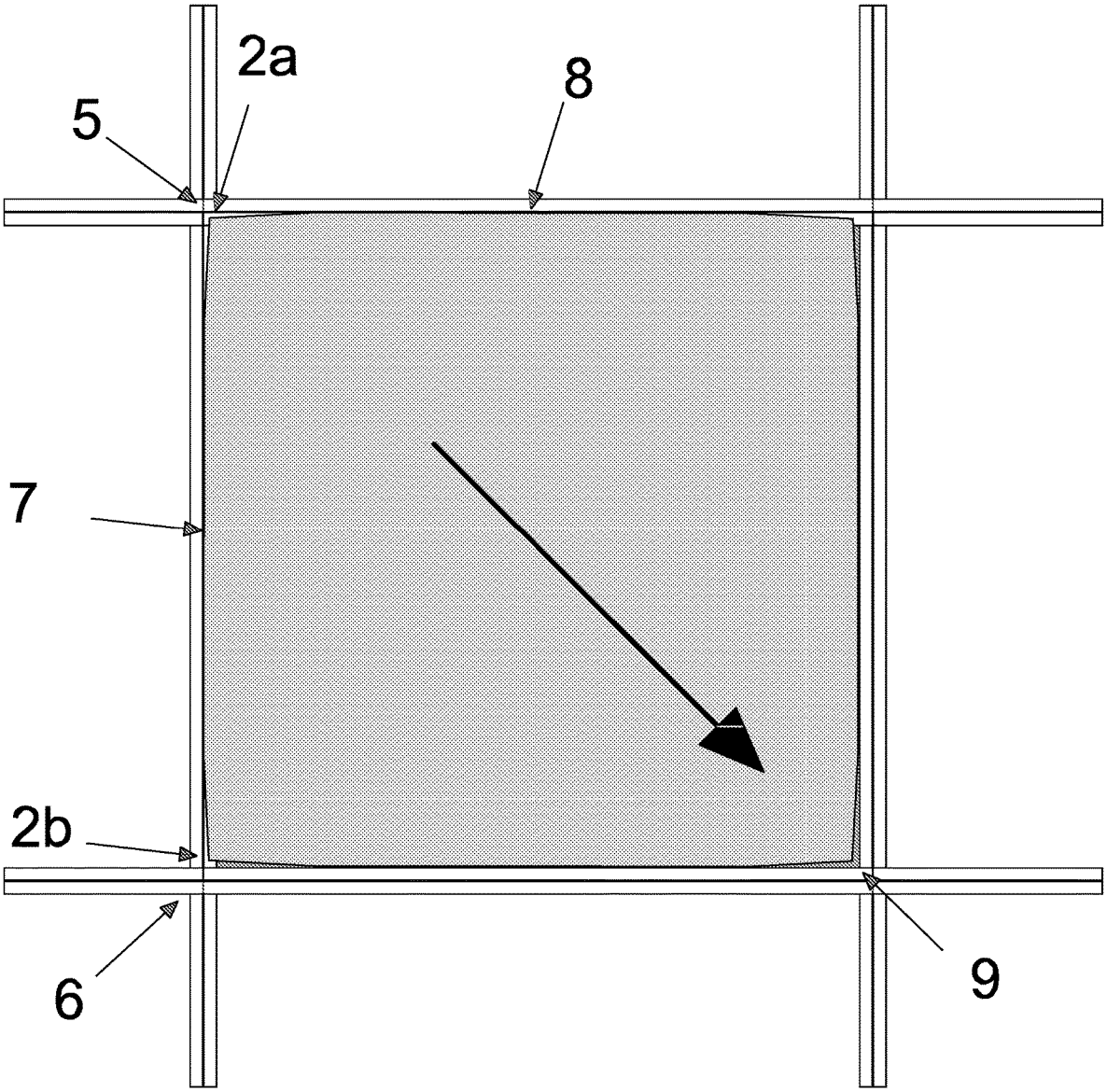
FIG. 7: represents the position of an exemplary ceiling module in a grid.
Figure 8:
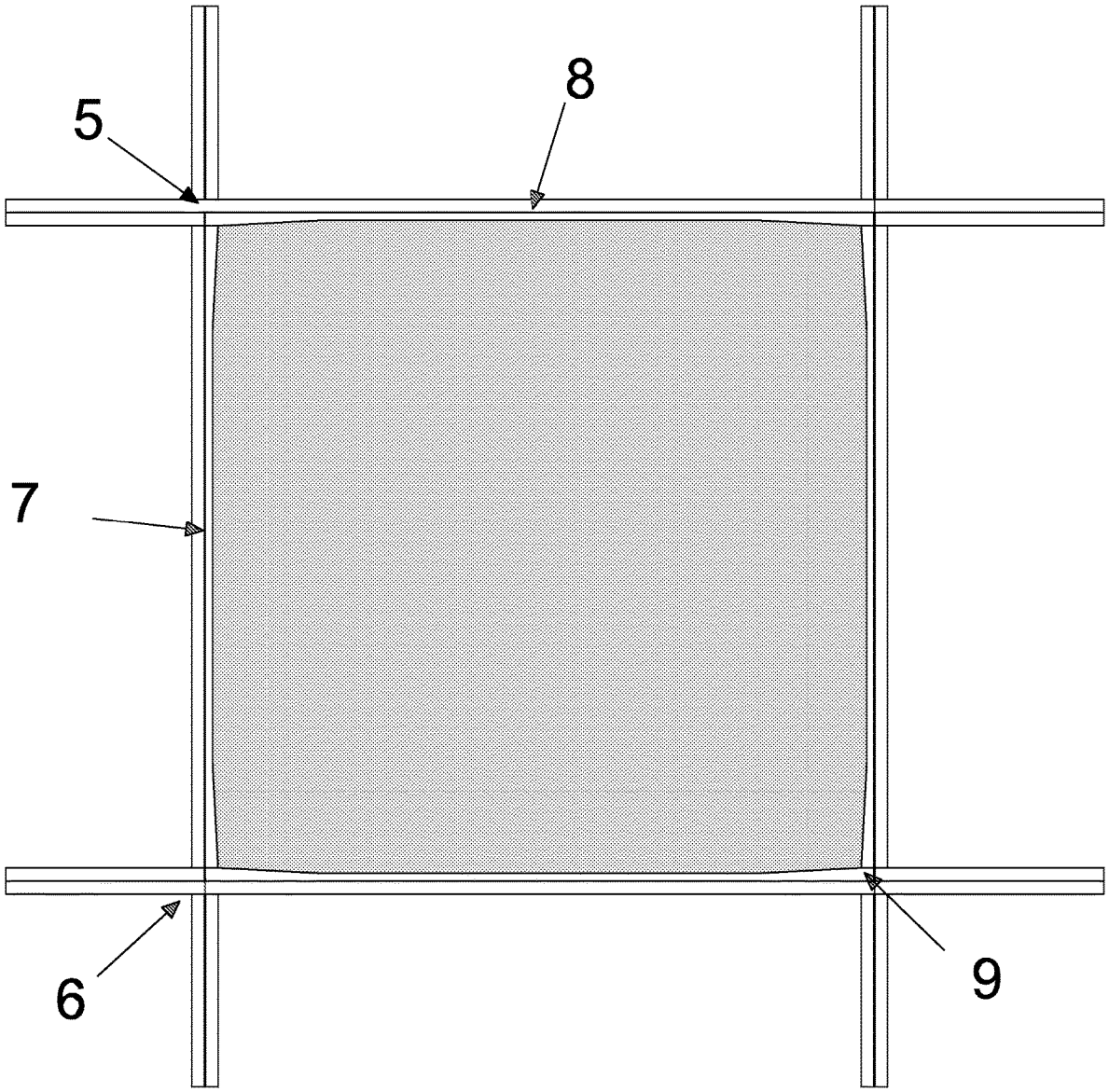
FIG. 8: represents a final position of an exemplary ceiling module, installed on the profiling, resting on the support flanges of the back.
Figure 9:
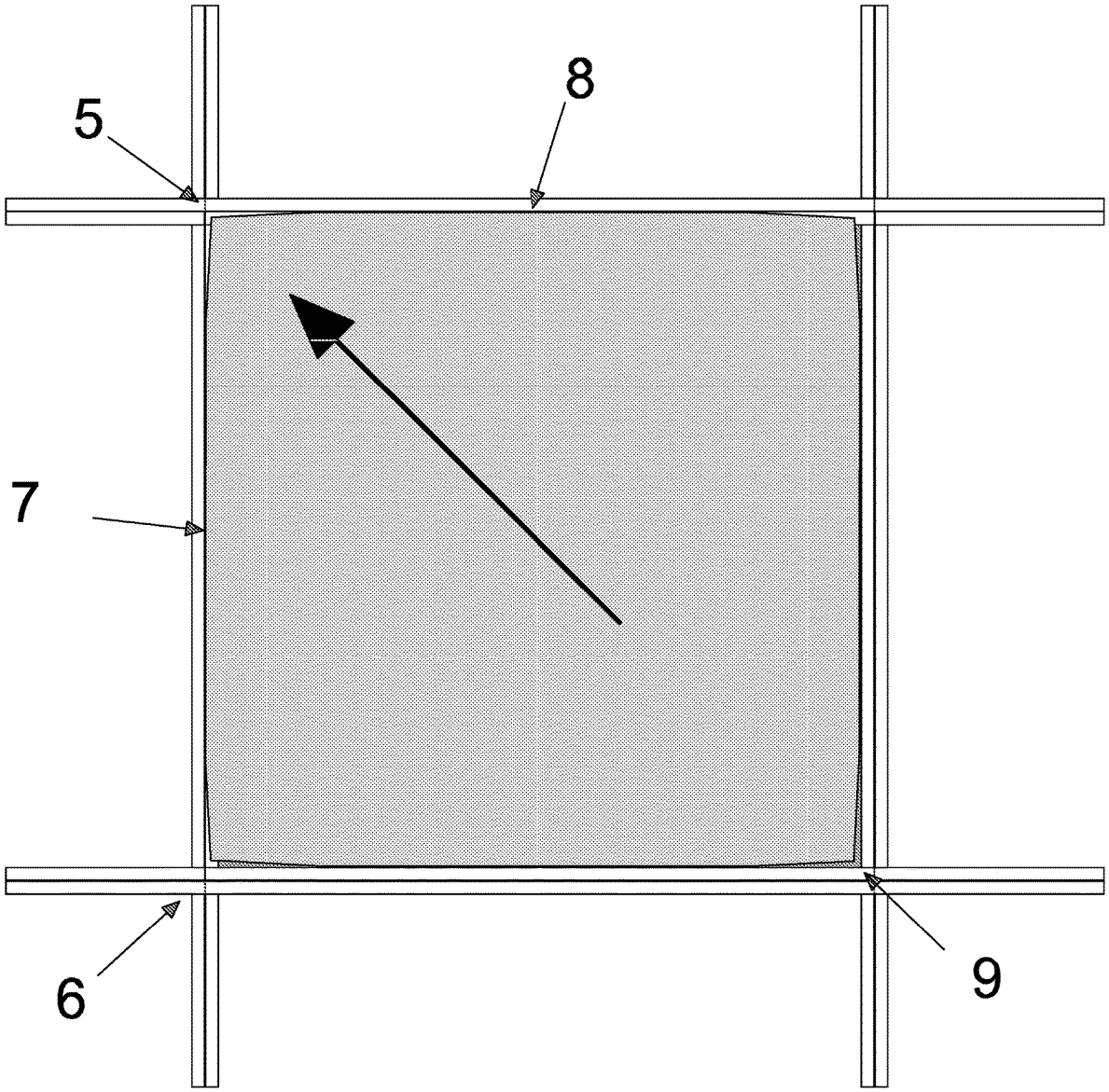
FIG. 9: represents a position of an exemplary ceiling module, after lifting it until it touches the grid and moving it diagonally towards a corner.
Figure 10:
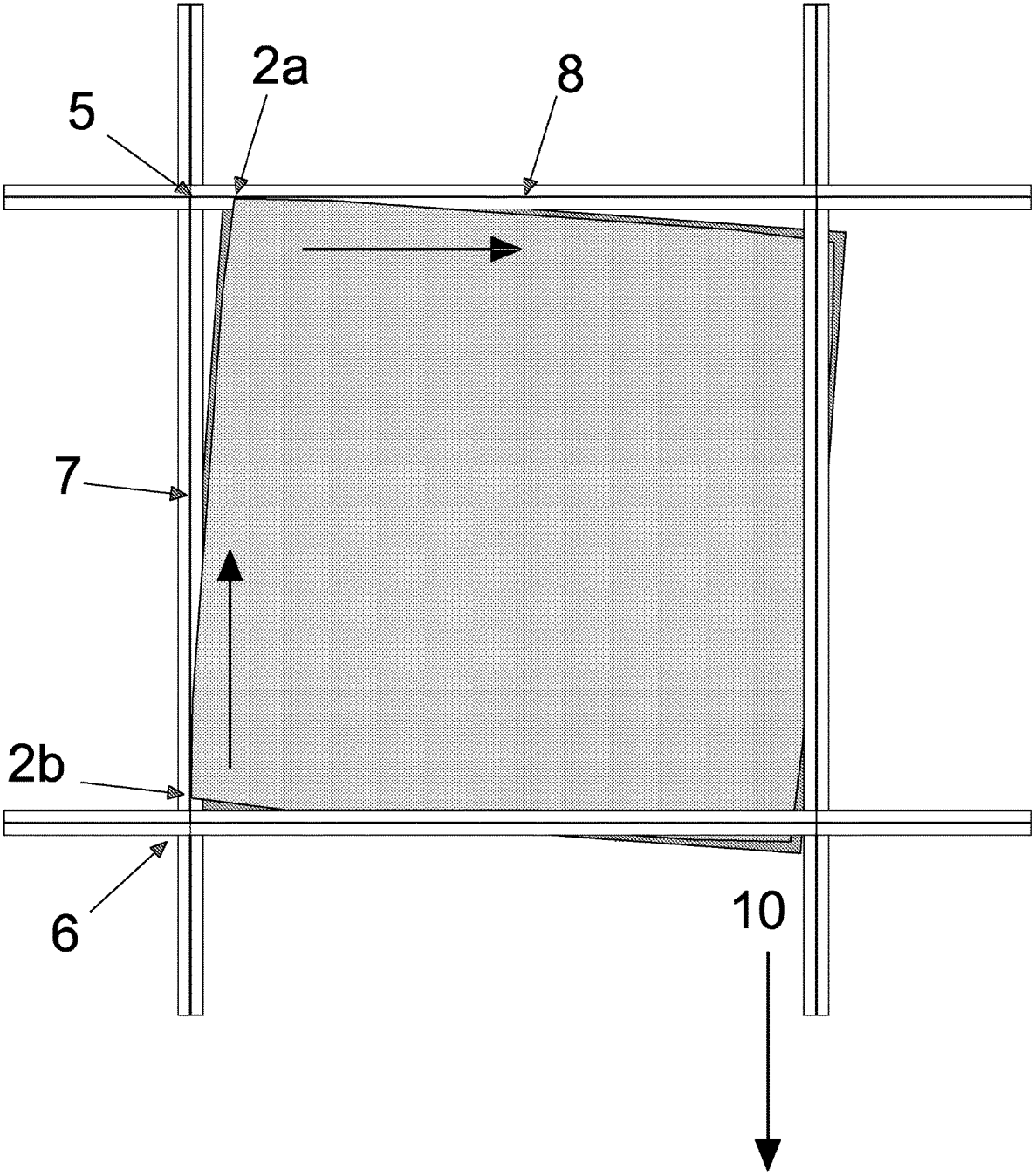
FIG. 10: represents a position of an exemplary ceiling module, after applying the translational movement with rotation, once the corner of the grid has been lowered, remaining in a free position to be removed.

The installation and removal method are the same as those of the registrable ceiling module described and illustrated above with reference to FIGS. 1-10, considering that when the profile is inserted into the largest recess, in this case the new face of the registrable ceiling module will be on the wing of the profile.

If we add a rectangle 5 mm thick by 25 mm long (11) to one of its edges of the face, and a rectangle of 5 mm thick by 25 mm long (11), with a spacing recess of 9 mm, we have a lowered Ganto that in one of the edges is a hidden profile. This registrable ceiling module can be defined as a hidden corridor profile ceiling module, where one is installed one after the other, covering the separation profile, leaving the last one only as a traditional lowered edge, so that the same lowered edge termination remains throughout. the perimeter of the installed "corridor ceiling", which is a lowered edge and which is a hidden profile in all the separations between registrable ceiling modules.

Increasing the format of the registrable ceiling module is very simple since the corners remain unchanged and only the length between them increases its dimension, the one that maintains its support throughout the length to be increased. This means that if we lengthen the width up to 120 cm, so that the installation recess can work, this will be the one that must increase its length, so the support section (e) to (f) will remain unchanged. This makes the support area of these sides decrease from 50% to 25%, that is, the recess will be 91.5 cm from the 122 cm long, which will not be supported or adjusted by that is, its anti-seismic quality will be lost. In addition, having the registrable ceiling module 91.5 cm unsupported, with a length of 122 cm, it will be affected by the deformation caused by the force of gravity, which would lead to increase its thickness, and therefore its weight, in order to make up for it.

The invention claimed is:

1. A registrable ceiling module installable from below comprising:

a face having a substantially rectangular shape with a first set of four vertices each comprising a right angle, a back disposed opposite the face and comprising a second set of four vertices each comprising an obtuse angle, and four module edges, wherein each of the module edges comprises:

a front flange extending from, and in a same plane as, the face and having a first thickness;

an installation recess disposed between the face and the back and having a second thickness and a first depth with respect to the first set of four vertices;

a fixing recess disposed between the back and the installation recess and having a third thickness and a second depth with respect to the first set of four vertices; and a support flange extending from, and in a same plane as, the back and having a fourth thickness, a third depth at a first portion extending along each of the module edges from each of the first set of four vertices to a second portion of each of the module edges, and a fourth depth at the second portion that is less than the third depth, wherein the third and fourth depths are with respect to the first set of four vertices.

2. The registrable ceiling module according to claim 1, wherein the first portion extends from each of the first set of four vertices to about 1 to cm along each of the module edges.

3. The registrable ceiling module according to claim 1, wherein each of the second portions is disposed between two of the first portions at each of the module edges.

4. A method for installing the registrable ceiling module of claim 1, comprising, in sequential order:

inserting the installation recess at first and second corners of the registrable ceiling module into two profile edges of a rectangle of a support grid, wherein the face is disposed downward and the registrable ceiling module is rotated about 20 degrees with respect to the rectangle of a support grid prior to the insertion;

moving the two corners parallel to the support grid and towards another two corners of the rectangle of a support grid until one or more of the module edges are substantially parallel to one or more of the profile edges;

lifting one or more of a third corner or a fourth corner of the registrable ceiling module such that an entirety of the back is above the two profile edges wherein the third and fourth corners are in a different location than the first and second corners; and moving the registrable ceiling module diagonally until the two profile edges are received by the fixing recesses.

5. The method of claim 4, further comprising uninstalling the registrable ceiling module, comprising performing the steps of claim 4 in a reverse of the sequential order.

6. The registrable ceiling module according to claim 1, wherein one or more of the first thickness is about 2 to 8 mm, the second thickness is about 2 to 5 mm, the third thickness is about 2 to 8 mm, or the fourth thickness is about 1.5 to 6 mm.

7. The registrable ceiling module according to claim 1, wherein one or more of the first depth is less than about 22 mm, the second depth is less than about 16 mm, or the third depth is about 2 to 10 mm.

8. The registrable ceiling module according to claim 1, wherein the four module edges comprise four edges of the installation recess and four edges of the support flange and the installation recess further comprises a third set of four vertices each comprising an obtuse angle such that each the four edges of the installation recess edges is parallel to a respective one of the four support flange edges.

9. A registrable ceiling module installable from below and comprising:

a face having a substantially rectangular shape with a first set of four vertices each comprising a right angle, a back coupled to the face and comprising a second set of four vertices each comprising an obtuse angle, and four module edges; and wherein each of the module edges comprises a support flange extending from, and in a same plane as, the back to thereby cause the back to be wider and longer than the face, wherein the face has a first depth at a first portion extending from each of the first set of four vertices along each of the module edges, and a second depth at a second portion between the first portions at each of the module edges, wherein the first depth is less than the second depth.

10. The registrable ceiling module of claim 9, wherein the first portion extends from each of the first set of four vertices to about 1 to 15 cm along each of the module edges.

11. A method for installing the registrable ceiling module of claim 9, comprising, in sequential order:

inserting the face at first and second corners of the registrable ceiling module adjacent to two of four profile edges of a rectangle of a support grid, wherein the face is disposed downward and the registrable ceiling module is rotated about 20 degrees with respect to the rectangle prior to the insertion;

moving the first and second corners parallel to the support grid towards another two corners of the rectangle of the support grid until one or more of the module edges are substantially parallel to one or more of the two of the four profile edges:

lifting one or more of a third corner or a fourth corner of the registrable ceiling module such that an entirety of the back is above the two of the four profile edges, wherein the third and fourth corners are different than the first and second corners; and moving the registrable ceiling module diagonally until each of the four profile edges support one of the module edges.

12. The method of claim 11, further comprising uninstalling the registrable ceiling module comprising performing the steps of claim 9 in a reverse of the sequential order.

* * * * *